US011679483B2

(12) United States Patent
Theiler et al.

(10) Patent No.: US 11,679,483 B2
(45) Date of Patent: Jun. 20, 2023

(54) ANGLED ADAPTER

(71) Applicant: MILWAUKEE ELECTRIC TOOL CORPORATION, Brookfield, WI (US)

(72) Inventors: Smith C. Theiler, Plymouth, WI (US); Jacob A. Krabbe, Milwaukee, WI (US); Michael J. Zimmermann, New Berlin, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 555 days.

(21) Appl. No.: 16/632,993

(22) PCT Filed: Jul. 25, 2018

(86) PCT No.: PCT/US2018/043637
§ 371 (c)(1),
(2) Date: Jan. 22, 2020

(87) PCT Pub. No.: WO2019/023319
PCT Pub. Date: Jan. 31, 2019

(65) Prior Publication Data

US 2020/0206886 A1 Jul. 2, 2020

Related U.S. Application Data

(60) Provisional application No. 62/536,773, filed on Jul. 25, 2017.

(51) Int. Cl.
*B25F 3/00* (2006.01)
*B25B 23/00* (2006.01)
*B25B 21/00* (2006.01)

(52) U.S. Cl.
CPC ..... *B25F 3/00* (2013.01); *B25B 23/0028* (2013.01); *B25B 23/0035* (2013.01); *B25B 21/00* (2013.01)

(58) Field of Classification Search
CPC ..... B25B 13/481; B25B 13/467; B25B 17/00; B25B 23/0028; B25B 23/0035;
(Continued)

(56) References Cited

U.S. PATENT DOCUMENTS 3,817,115 A * 6/1974 Schnizler ..... F16H 57/027 74/417
4,242,931 A * 1/1981 Clement ..... B25B 13/481 81/57.29

(Continued)

FOREIGN PATENT DOCUMENTS

DE 102012224437 A1 7/2014
EP 2604392 A2 6/2013

(Continued)

OTHER PUBLICATIONS

Extended European Search Report for Application No. 18838740.1 dated Sep. 3, 2021 (7 pages).

(Continued)

*Primary Examiner* — Orlando E Aviles
*Assistant Examiner* — Jason Khalil Hawkins
(74) *Attorney, Agent, or Firm* — Michael Best & Friedrich LLP

(57) ABSTRACT

An angled adapter for coupling a tool bit to a tool includes a housing and a transmission assembly positioned in the housing. The transmission assembly is configured to convert an input torque about a first axis from the tool to an output torque about a second axis acting on the tool bit. The second axis is disposed at an angle relative to the first axis. The angled adapter also includes a shank supported by the housing and including a tool coupling portion configured to couple to the tool. The tool coupling portion has an outer dimension. The shank also includes a transmission coupling portion coupled to the transmission assembly, and an inter- (Continued)

mediate portion extending between the tool coupling portion and the transmission coupling portion. The intermediate portion has a diameter that is less than the outer dimension.

24 Claims, 5 Drawing Sheets

(58) Field of Classification Search
CPC ... B25B 21/00; B25F 3/00; F16H 1/12; Y10T 279/3412; Y10T 74/1966; Y10T 74/19665
USPC ..... 279/144; 81/57.13, 57.29, 57.12, 57.28; 74/416; 173/29, 216
See application file for complete search history.

(56) References Cited

U.S. PATENT DOCUMENTS 4,453,433 A * 6/1984 Clement ..... B25B 17/00 81/57.29
4,580,472 A 4/1986 Kastner
4,643,052 A 2/1987 Badiali
5,697,739 A 12/1997 Lewis et al.
6,047,616 A * 4/2000 Ochiai ..... B25B 13/467 81/58
6,112,621 A * 9/2000 Ochiai ..... B25B 13/463 81/57.13
9,314,852 B2 * 4/2016 Santamarina ..... B25B 23/0035
2005/0279519 A1 * 12/2005 Clark ..... B25B 21/026 173/216
2013/0154205 A1 6/2013 Santamarina et al.
2016/0332286 A1 * 11/2016 Chiang ..... B25B 21/007

FOREIGN PATENT DOCUMENTS

WO 2008001031 1/2008
WO 2010054169 A1 5/2010

OTHER PUBLICATIONS

International Search Report and Written Opinion for Application No. PCT/US2018/043637 dated Oct. 29, 2018 (16 pages).

* cited by examiner

| SAMPLE # | PRIOR ART RIGHT ANGLE ADAPTER (150) | RIGHT ANGLE ADAPTER #1 (10') | RIGHT ANGLE ADAPTER #2 (10") |
|---|---|---|---|
| # 1 | 31 ROUNDS | 135 ROUNDS | 162 ROUNDS |
| # 2 | 38 ROUNDS | 145 ROUNDS | 256 ROUNDS |
| # 3 | 33 ROUNDS | 139 ROUNDS | 261 ROUNDS |
| # 4 | 27 ROUNDS | 153 ROUNDS | 98 ROUNDS |
| # 5 | 32 ROUNDS | 135 ROUNDS | 210 ROUNDS |
| AVERAGE | 32.20 ROUNDS | 141.40 ROUNDS | 197.40 ROUNDS |
| ONE ROUND = 55 CYCLES: DRIVE 25 BOLTS IN TO STEEL BLOCK WITH NUTS + DRIVE 30 LAG SCREWS IN 6"X6" WOOD WITH PRE-DRILLED HOLES | | | |

*FIG. 7*

ANGLED ADAPTER

CROSS-REFERENCE TO RELATED APPLICATIONS

This application is a national phase filing under 35 U.S.C. 371 of International Application No. PCT/US2018/043637 filed Jul. 25, 2018, which claims priority to U.S. Provisional Patent Application No. 62/536,773 filed Jul. 25, 2017, the entire contents of all of which are incorporated herein by reference.

BACKGROUND

The present invention relates to accessory tools, and more particularly to accessory tool adapters.

Various power tools that use tool bits are known in the art. Some power tools operate utilizing a rotational force (e.g. mechanical energy, etc.) to rotatably drive the tool bit. The power tools may be used for cutting workpieces and/or driving fasteners (e.g., bolts, screws, etc.) into the workpieces using the tool bits. In some instances, a power tool may be positioned at a desired angle relative to the workpiece for performing the cutting and/or driving. The desired angle, however, may be difficult to achieve due to the positioning of the power tool relative to the workpiece.

SUMMARY

The present application provides, in one aspect, an angled adapter for coupling a tool bit to a tool. The angled adapter including a housing and a transmission assembly positioned in the housing. The transmission assembly is configured to convert an input torque about a first axis from the tool to an output torque about a second axis acting on the tool bit. The second axis is disposed at an angle relative to the first axis. The angled adapter also includes a shank supported by the housing and including a tool coupling portion configured to couple to the tool. The tool coupling portion has an outer dimension. The shank also includes a transmission coupling portion coupled to the transmission assembly, and an intermediate portion extending between the tool coupling portion and the transmission coupling portion. The intermediate portion has a diameter that is less than the outer dimension.

The present application provides, in another aspect, an angled adapter for coupling a tool bit to a tool. The angled adapter includes a housing and a transmission assembly positioned in the housing. The transmission assembly is configured to convert an input torque about a first axis from the tool to an output torque about a second axis acting on the tool bit. The second axis is disposed at an angle relative to the first axis. The angled adapter also includes a shank supported by the housing and including a tool coupling portion configured to couple to the tool. The tool coupling portion has a hexagonal cross-section with a first outer dimension. The tool coupling portion defines a groove configured to receive a retention member of the tool. The shank also includes a transmission coupling portion coupled to the transmission assembly. The transmission coupling portion has a second outer dimension. The shank further includes a body positioned between the tool coupling portion and the transmission coupling portion. The body has a third outer dimension. The shank also includes a first reduced diameter portion extending from the tool coupling portion to the body. The first reduced diameter portion has a first diameter that is less than the first outer dimension, the second outer dimension, and the third outer dimension. The shank further includes a second reduced diameter portion extending from the body to the transmission coupling portion. The second reduced diameter portion has a second diameter that is less than the first outer dimension, the second outer dimension, and the third outer dimension.

The present application provides, in another aspect, an angled adapter for coupling a tool bit to a tool. The angled adapter includes a housing, a first bevel gear positioned in the housing for rotation about a first axis, and a second bevel gear positioned in the housing and operatively engaged with the first bevel gear. The second bevel gear is configured to rotate the tool bit about a second axis. The second axis is disposed at an angle relative to the first axis. The angled adapter also includes a shank supported by the housing and including a tool coupling portion configured to couple to the tool. The tool coupling portion has an outer dimension. The shank also includes a transmission coupling portion coupled to the first bevel gear, and an intermediate portion extending between the tool coupling portion and the transmission coupling portion. The intermediate portion has a diameter that is less than the outer dimension.

Other features and aspects of the invention will become apparent by consideration of the following detailed description and accompanying drawings.

BRIEF DESCRIPTION OF THE DRAWINGS

FIG. 7 is a table of test results for various angled adapters.

DETAILED DESCRIPTION

Figure 1:
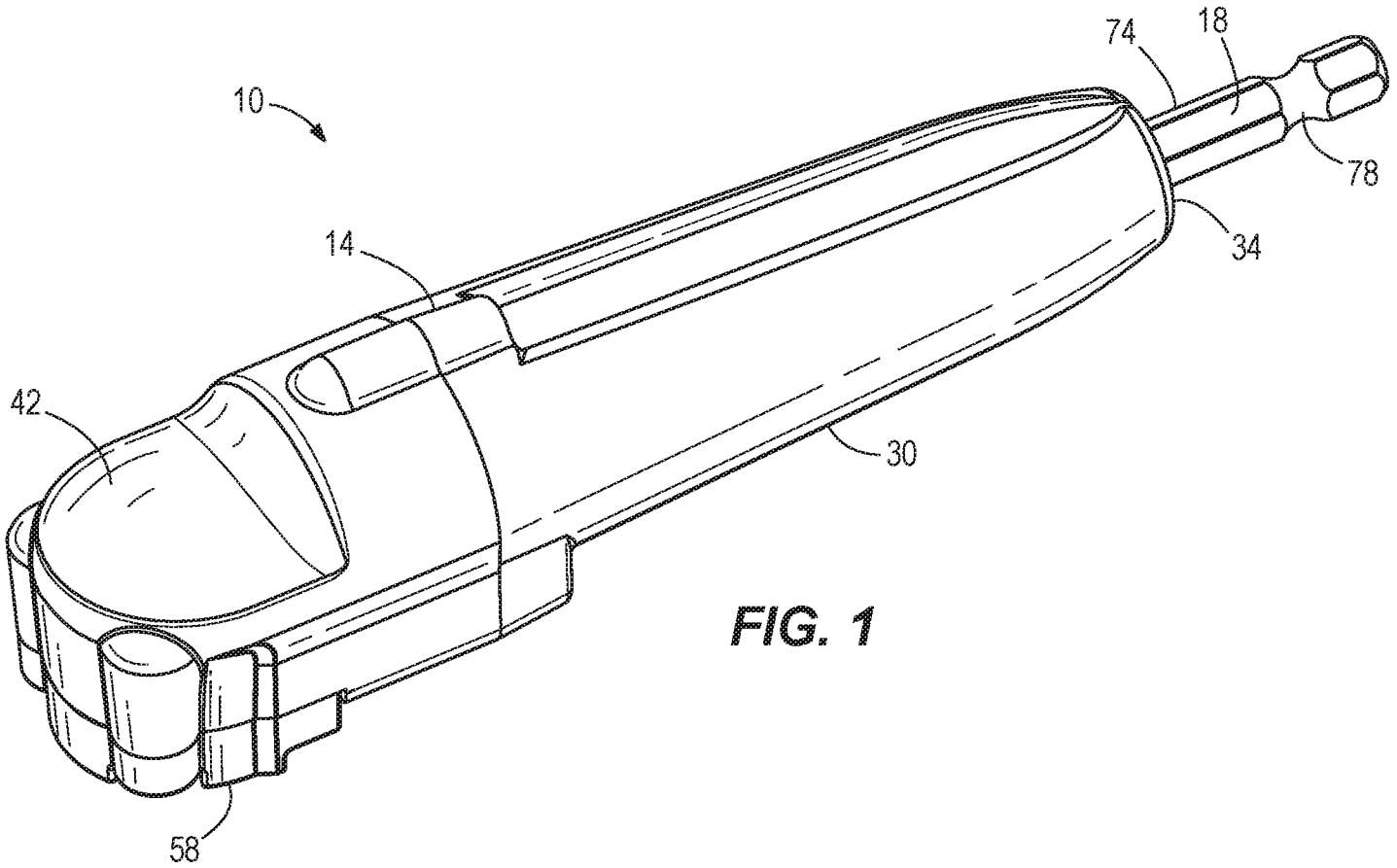
FIG. 1 is a perspective view of an angled adapter.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. As used herein, the term "approximately" is meant to encompass values within a rounding value or manufacturing tolerance of the listed values. Also, it is to be understood that the phraseology and terminology used herein is for the purpose of description and should not be regarded as limiting.

FIGS. 1-6 illustrate an angled adapter 10 (referred to hereinafter simply as "adapter") configured to be operatively coupled to a tool (e.g., a power tool, such as a drill) and a tool bit. The adapter 10 includes a housing 14 supporting a shank 18 and a transmission assembly 22. The shank 18 is driven to rotate about a first axis A1 (FIG. 5) by a torque applied by the tool. The shank 18 is operatively coupled to the transmission assembly 22. The transmission assembly 22 converts the input torque about the first axis A1 to an output torque acting on a tool bit to drive the tool bit to rotate along a second axis A2 that disposed at an angle relative to the first axis A1. The angle may be approximately 75-120 degrees. More specifically, the angle may be approximately 90-105 degrees. In one specific example, the angle may be approximately 90 degrees. In another specific example, the angle may be approximately 105 degrees. As will be described in greater detail below, the shank 18 includes at least one axial section having a reduced diameter. This section absorbs impact forces to increase the durability and longevity of the adapter 10 by, for example, reducing the transmission of impact forces generated by the tool to the transmission assembly 22.

With continued reference to FIGS. 1-6, the housing 14 includes a first section 30 including a shank receiving aperture 34 (FIG. 2) at a first end and a first transmission aperture 38 at a second end with a first cavity 26 defined therebetween. The second end of the first section 30 is coupled to a second section 42 of the housing 14. The first section 30 may be coupled to the second section 42 by, for example, a set of fasteners. The second section 42 of the housing 14 includes a second transmission aperture 46 in facing relation to the first transmission aperture 38 and a tool bit adapter aperture 50 disposed at an angle relative to the first and second transmission apertures 38, 46. That is, a plane defined by the first and second transmission apertures 38, 46 is angled (e.g., perpendicular) to a plane defined by the tool bit adapter aperture 50. The tool bit adapter aperture 50 is disposed in facing relation to a tool bit aperture 54 of a third section 58 of the housing 14. The second section 42 may be coupled to the third section 58 by, for example, a set of fasteners. In other embodiments, the housing 14 may include fewer or more sections, and/or the sections may be coupled together using other suitable means.

Figure 2:
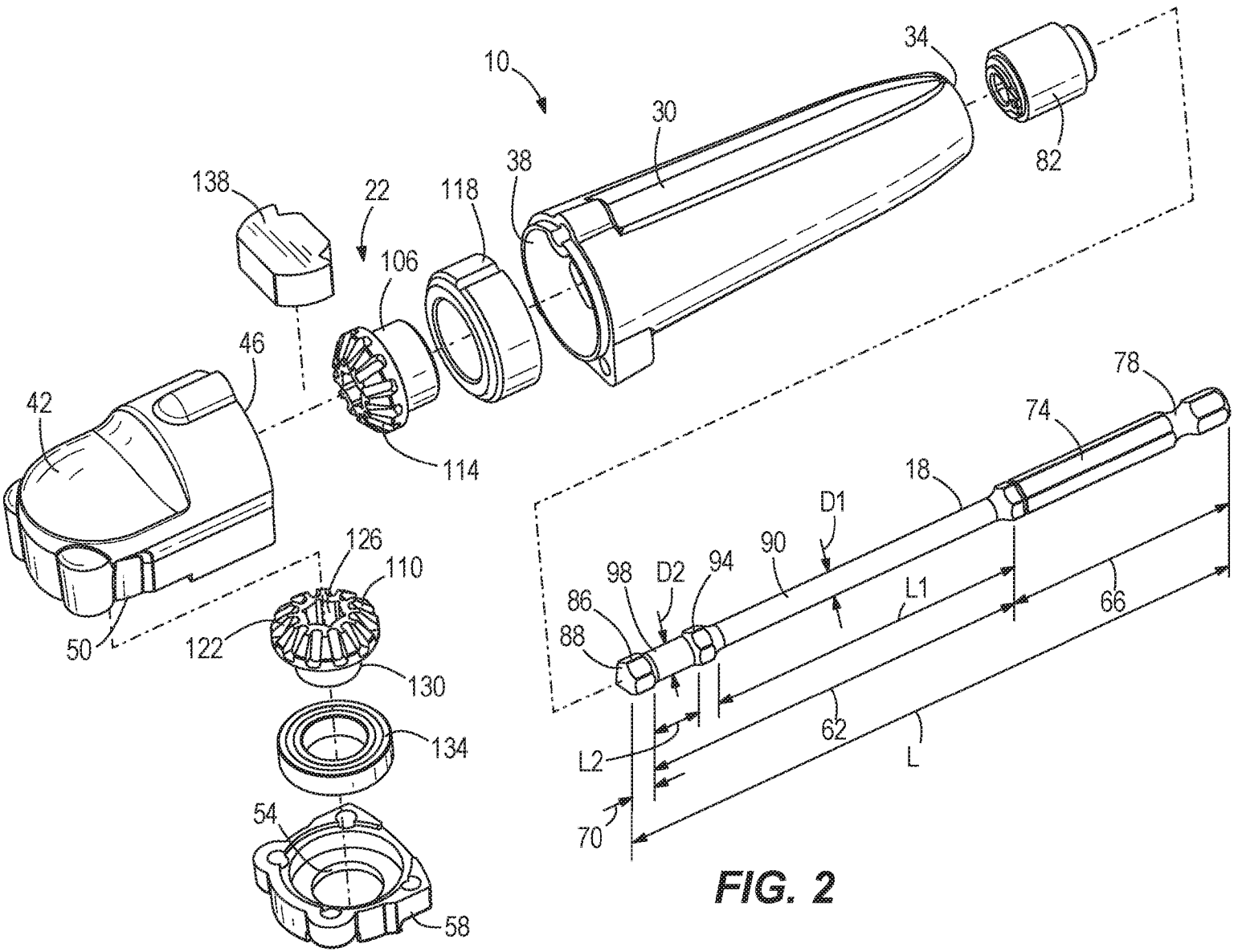
FIG. 2 is an exploded view of the angled adapter.
Figure 3:
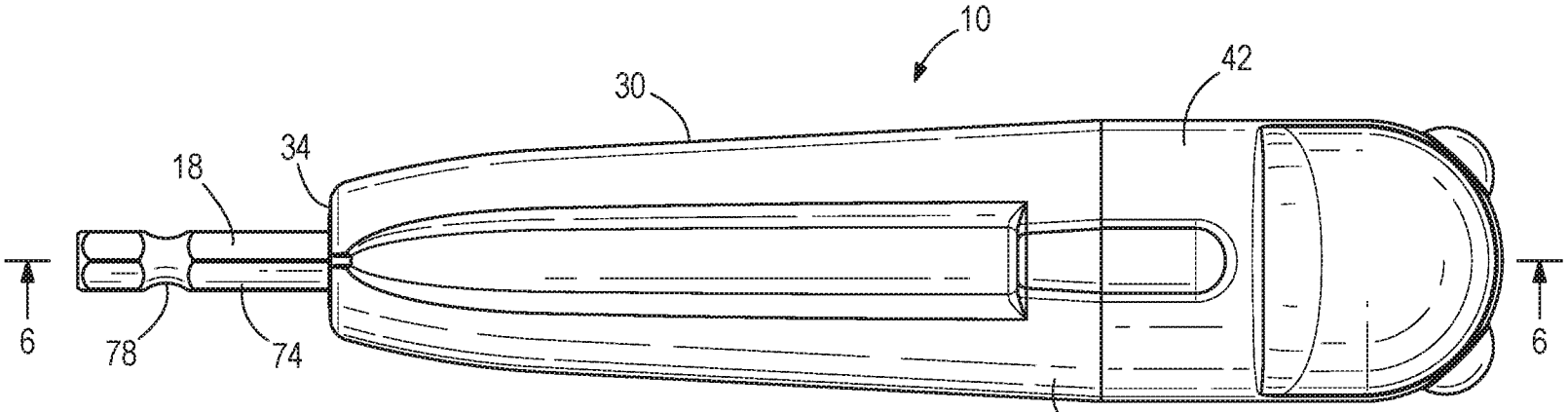
FIG. 3 is a top view of the angled adapter.
Figure 6:
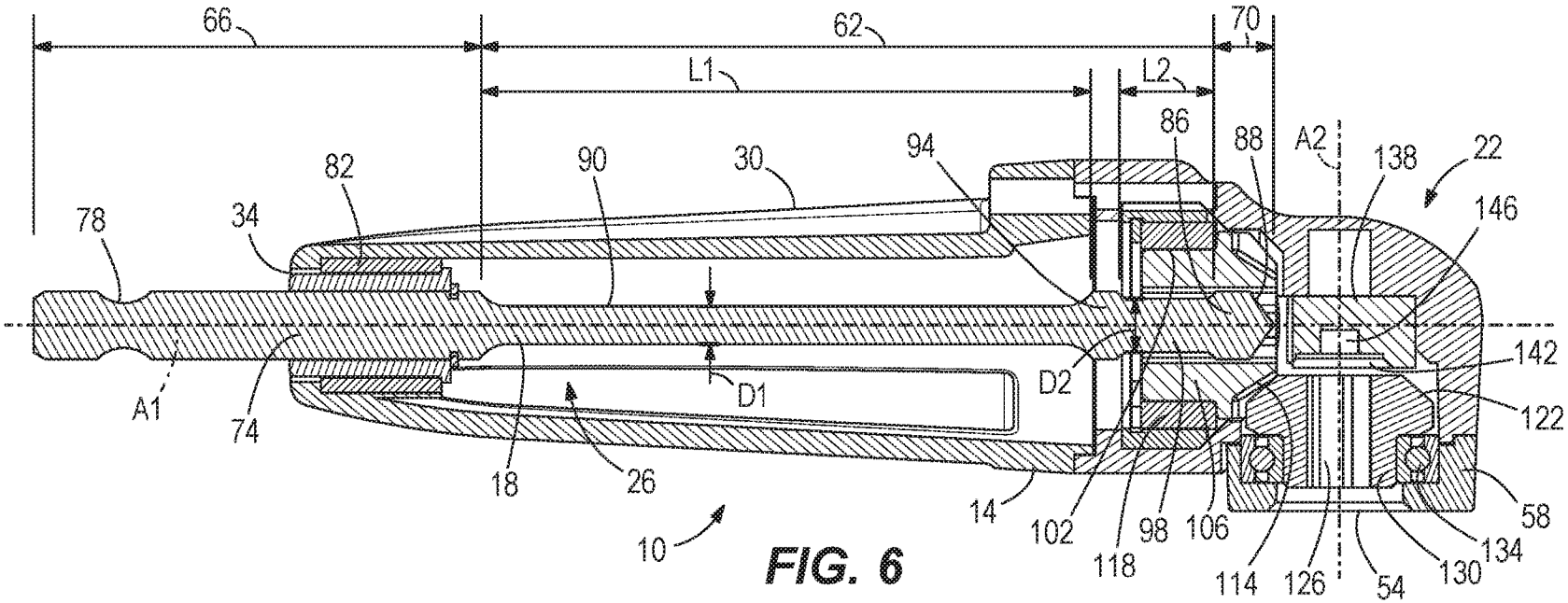
FIG. 6 is a cross-sectional view of the angled adapter taken along section line 6-6 of FIG. 3.

With specific reference to FIG. 2, the shank 18 includes an intermediate portion 62 extending between a tool coupling portion 66 and a transmission coupling portion 70. In the illustrated embodiment, the intermediate portion 62, the tool coupling portion 66, and the transmission coupling portion 70 are integrally formed as a single piece. In other embodiments, the portions 62, 66, 70, may be formed as separate pieces that are permanently or releasably secured together. The tool coupling portion 66 includes a body 74 and a groove 78. In the illustrated embodiment, the body 74 has a hexagonal cross-section. At least a portion of the body 74 is engageable with the tool to rotationally couple the shank 18 to the tool, and the groove 78 receives a retention member of the tool (e.g., a detent ball, a clip, etc.) to maintain engagement between the shank 18 and the tool. Another portion of the body 74 extends into the first section 30 of the housing 14 and is rotationally supported by an input bearing 82 (FIG. 6). The transmission coupling portion 70 includes a body 86. The illustrated body 86 has a hexagonal cross-section and a rounded end 88 disposed on an end of the shank 18 opposite the tool coupling portion 66. The body 86 of the transmission coupling portion 70 is operatively engageable with the transmission assembly 22.

The body 74 of the tool coupling portion 66 and the body 86 of the transmission coupling portion 70 each have an outer dimension. In the illustrated embodiment, the body 74 and the body 86 each have a hexagonal shape in which the outer dimension is defined as a width extending between two opposite flat sides of the hexagonal shape. In other embodiments, the body 74 and the body 86 may have a different shape. For example, the body 74 and/or the body 86 may have a rectangular shape in which the outer dimension is defined as a width extending between two opposite sides of the rectangular shape, or may have a cylindrical shape in which the outer dimension is a diameter. In other embodiments, the body 74 and the body 86 may have the same or different shapes.

The illustrated intermediate portion 62 includes a first reduced diameter portion 90, a body 94, and a second reduced diameter portion 98. The first reduced diameter portion 90 extends from the tool coupling portion 66 to the body 94. The second reduced diameter portion 98 extends from the body 94 to the transmission coupling portion 70, and is received by a bearing 102 (FIG. 6) such that the shank 18 is further rotationally supported within the housing 14. Similar to the body 74 and the body 86, the body 94 has an outer dimension. In the illustrated embodiment, the body 94 has a hexagonal shape in which the outer dimension is defined as a width extending between two opposite flat sides of the hexagonal shape. The body 94 may have the same or different shape as the body 74 and/or the body 86.

As shown in FIG. 2, the first reduced diameter portion 90 has a diameter D1 and the second reduced diameter portion 98 has an outer diameter D2 that are each less than the outer dimension of either the hexagonal body 74 of the tool coupling portion 66, the body 86 of the transmission coupling portion 70, or the body 94 of the intermediate portion 62. In this embodiment, the diameter D1 of the first reduced diameter portion 90 is less than the diameter D2 of the second reduced diameter portion 98. However, in other embodiments, the diameter D1 of the first reduced diameter portion 90 may be greater than or equal to than the diameter D2 of the second reduced diameter portion 98.

With continued reference to FIG. 2, the shank 18 includes a total length L extending along the axis A1. In the illustrated embodiment, the tool coupling portion 66, the first reduced diameter portion 90, the body 94, the second reduced diameter portion, and the transmission coupling portion 70 each form a portion of the total length L. In other embodiments, only the tool coupling portion 66, the first reduced diameter portion 90, and the transmission coupling portion 70 each form a portion of the total length L. The first reduced diameter portion 90 has an axial length L1 that forms a portion of the total length L. The second reduced diameter portion 98 has an axial length L2 that forms a portion of the total length L. In the illustrated embodiment, the length L1 of the first reduced diameter portion 90 forms more than half of the total length L. In other embodiments, the length L1 of the first reduced diameter portion 90 forms at least a quarter of the total length L. Furthermore, in the illustrated embodiment, the axial length L1 of the first reduced diameter portion 90 is greater than the axial length L2 of the second reduced diameter portion 98. For example, in some embodiments, the axial length L1 of the first reduced diameter portion 90 may be at least twice as long as the axial length L2 of the second reduced diameter portion 98. In other embodiments, the axial length L1 may be between two and ten times as long as the axial length L2. In the illustrated embodiment, the axial length L1 is approximately six times the axial length L2. In other embodiments, the axial length L1 of the first reduced diameter portion 90 may be equal to or less than the axial length L2 of the second reduced diameter portion 98.

In an alternate embodiment, the intermediate portion 62 includes only the first reduced diameter portion 90. In this embodiment, the body 98 and the body 86 form a continuous segment that extends from the first reduced diameter portion 90 to the rounded end 88.

The first reduced diameter portion 90 may have an outer diameter of approximately 4.5 mm-5 mm. The second reduced diameter portion 98 may have an outer diameter of approximately 5.6 mm-5.8 mm. In a specific embodiment, the first reduced diameter portion 90 may have an outer diameter of approximately 4.5 mm, and the second reduced diameter portion 98 may have an outer diameter of approximately 5.7 mm. The outer dimension of the body 74, the body 94, and the body 86 may be approximately 7 mm-10 mm. The axial length L1 of the first reduced diameter portion 90 may be approximately 60 mm-70 mm. The axial length L2 of the second reduced diameter portion 98 may be approximately 9 mm-12 mm. In a specific embodiment, the first reduced diameter portion 90 may have an axial length L1 of approximately 65 mm, and the second reduced diameter portion 98 may have an axial length L2 of approximately 10.5 mm.

A ratio of the axial length L1 of the first reduced diameter portion 90 to the outer dimension of the tool coupling portion 66 is at least 1.5. In some embodiments, the ratio is between 6 and 10. For example, in one embodiment, the axial length L1 of the first reduced diameter portion 90 is 60 mm, and the outer dimension of the tool coupling portion 66 is 8 mm such that the ratio between the axial length L1 and the outer dimension of the tool coupling portion 66 is 7.5. Alternatively, a ratio of the axial length L1 of the first reduced diameter portion 90 to the diameter D1 of the first reduced diameter portion 90 is at least 1.5. In some embodiments, the ratio is between 12 and 16. For example, in one embodiment, the axial length L1 of the first reduced diameter portion 90 is 60 mm, and the diameter D1 of the first reduced diameter portion 90 is 5 mm such that the ratio between the axial length L1 and the diameter D1 is 12.

With reference to FIGS. 2 and 6, the illustrated transmission assembly 22 includes a first bevel gear 106 coupled to a second bevel gear 110. The first bevel gear 106 includes a plurality of teeth 114 and a hexagonally shaped bore 118 that extends along the first axis A1 and receives the body 86 of the transmission coupling portion 70. The second bevel gear 110 also includes a plurality of teeth 122 and a hexagonally shaped bore 126 that extends along the second axis A2 and receives a tool bit. Furthermore, the second bevel gear 110 includes a cylindrical extension 130 that is rotationally supported by an output bearing 134 coupled between the second and third sections 42, 58 of the housing 14. When assembled, the teeth 114 of the first bevel gear 106 and the teeth 122 of the second bevel gear 110 are intermeshed such that rotation of the first bevel gear 106 about the first axis A1 results in rotation of the second bevel gear 110 about the second axis A2. In other embodiments, the transmission assembly 22 may include other suitable gears or configurations.

Figure 4:
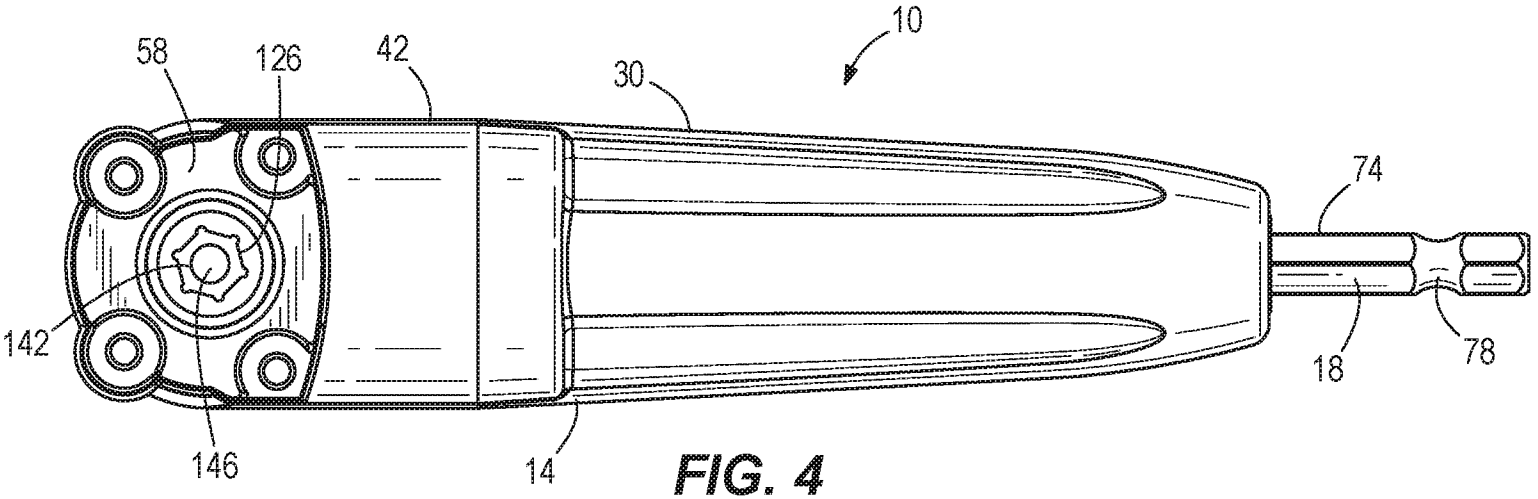
FIG. 4 is a bottom view of the angled adapter.
Figure 5:
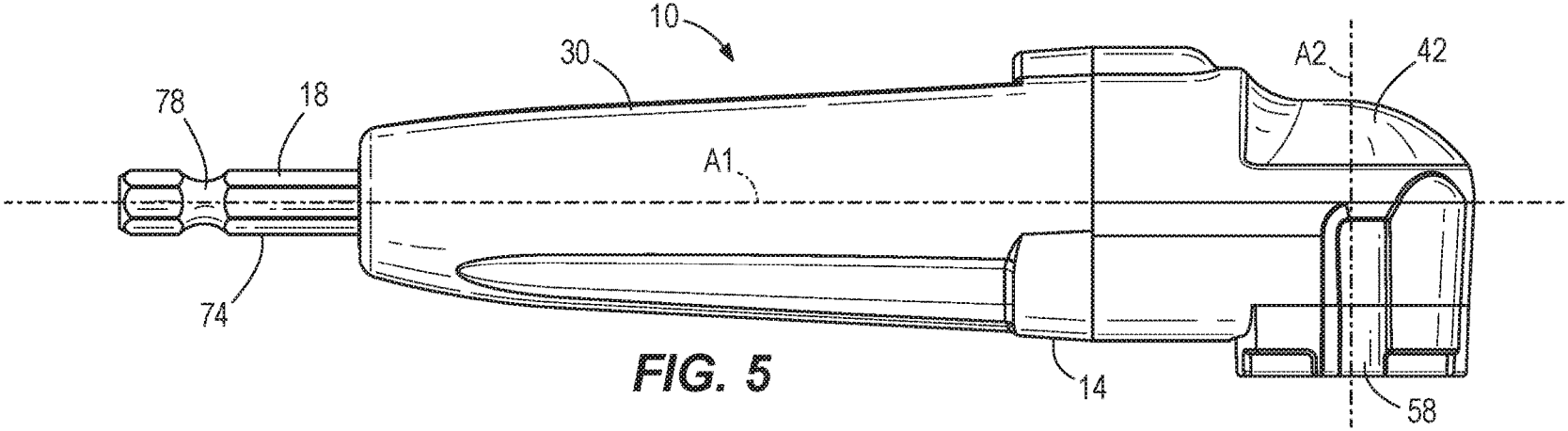
FIG. 5 is a side view of the angled adapter.

As shown in FIGS. 2 and 6, a coupling member 138 is supported within the second section 42 of the housing 14 adjacent the transmission assembly 22. The coupling member 138 includes a recess 142 (FIG. 6) that is aligned with the hexagonal bore 126 of the second bevel gear 110. An inner surface of the recess 142 forms an abutment wall that engages an end of the tool bit. Furthermore, a bore 146 may be included in the recess 142 to receive, for example, a magnet that retains the tool bit within the adapter 10 (FIG. 4).

In operation, a torque is applied by the tool to the tool coupling portion 66 of the shank 18 to drive rotation of the shank 18. The rotation of the shank 18 drives rotation of the first bevel gear 106 about the first axis A1 via the operative engagement between the body 86 of the transmission coupling portion 70 and the hexagonal bore 118 in the first bevel gear 106. Concurrently, the second bevel gear 110 is driven to rotate about the second axis A2 via engagement between the teeth 114 of the first bevel gear 106 and the teeth 122 of the second bevel gear 110. A tool bit is retained within the bore 126 of the second bevel gear 110 for rotation with the second bevel gear 110. Accordingly, the angled adapter 10 converts the torque applied to the shank 18 to generate rotation of the shank 18 about the first axis A1 to rotation of the tool bit about the second axis A2.

The adapter 10 described above has certain advantages over prior art adapters. For example, the presence of reduced diameter portions 90, 98 on the shank 18 enhances the overall durability and usable lifetime of the angled adapter 10 because the reduced diameter portions 90, 98 absorb impact forces generated during operation. This absorption of impact forces improves the durability of the shank 18 (e.g., inhibits breakage of the shank 18) and reduces the forces from acting on the transmission assembly 22, which reduces the possibility of wearing and eventual failure of the transmission assembly 22 (e.g., inhibits excessive wearing of the teeth of the bevel gears). In the embodiment described above, the reduced diameter portion 90 has dimensional characteristics (e.g., D1, L1) that provide a static strength that is the same as the static strength of the first bevel gear 106 and the second bevel gear 106. This configuration further enhances the durability and usable lifetime of the angled adapter 10.

Advantages of the adapter 10 are illustrated in FIG. 7 which includes testing of three angled adapters: one conventional adapter without a reduced diameter portion 150, one angled adapter 10' according to the invention including a 5 mm reduced diameter portion 90, 98 (i.e., Right Angle Adapter #1), and one angled adapter 10" according to the invention including a 4.5 mm reduced diameter portions 90, 98 (i.e., Right Angle Adapter #2). The testing was conducted to determine relative durability and longevity of the adapters 150, 154, 158. The testing consisted of measuring the number of testing rounds each adapter could complete prior to failure (e.g., failure of the transmission assembly 22). Each round of testing included (1) driving 25 bolts into a steel block with nuts, and (2) driving 30 lag screws into a 6"×6" wood workpiece with pre-drilled holes (i.e., total of 55 cycles). Furthermore, five samples were completed by each of the three angled adapters to calculate an average number of testing rounds completed. As seen in this table, the conventional angled adapter (with no reduced diameter portions 90, 98) averaged 32.2 rounds prior to failure, whereas the angled adapter according to the invention including 5 mm reduced diameter portion 90, 98 averaged 141.4 rounds prior to failure, and the angled adapter according to the invention including a 4.5 mm reduced diameter portion 90, 98 averaged 197.4 rounds prior to failure. As such, the angled adapter described herein possesses significant advantages over the prior art.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An angled adapter for coupling a tool bit to a tool, the angled adapter comprising: a housing; a transmission assembly positioned in the housing, the transmission assembly configured to convert an input torque about a first axis from the tool to an output torque about a second axis acting on the tool bit, the second axis disposed at an angle relative to the first axis; and a shank supported by the housing, the shank extending along the first axis and including a tool coupling portion configured to couple to the tool, the tool coupling portion having an outer dimension, the outer dimension being transverse to the first axis, a transmission coupling portion coupled to the transmission assembly, and an intermediate portion extending between the tool coupling portion and the transmission coupling portion, the intermediate portion having a diameter that is less than the outer dimension; wherein the intermediate portion defines a length, the shank has a total length, and the length of the intermediate portion forms at least half of the total length, and wherein the transmission coupling portion includes a body coupled to the transmission assembly to drive rotation of the tool bit, wherein the body has an outer dimension, and wherein the diameter of the intermediate portion is less than the outer dimension of the body of the transmission coupling portion.

2. The angled adapter of claim 1, wherein the outer dimension of the tool coupling portion is at least 7 mm, and wherein the diameter is between 4.5 mm and 5 mm.

3. The angled adapter of claim 1, wherein the intermediate portion includes a first reduced diameter portion and a second reduced diameter portion separated by a intermediate portion body, wherein the intermediate portion body has a second outer dimension, wherein the first reduced diameter portion has the diameter, wherein the second reduced diameter portion has a second diameter, and wherein the diameter and the second diameter are less than the second outer dimension.

4. The angled adapter of claim 3, wherein the diameter of the first reduced diameter portion is less than the second diameter of the second reduced diameter portion.

5. The angled adapter of claim 3, wherein the diameter of the first reduced diameter portion is between 4.5 mm and 5 mm, and wherein the second diameter is between 5.6 mm and 5.8 mm.

6. The angled adapter of claim 3, wherein the first reduced diameter portion defines a first length, and wherein the second reduced diameter portion defines a second length that is less than the first length.

7. The angled adapter of claim 6, wherein the first length is between 60 mm and 70 mm, and wherein the second length is between 9 mm and 12 mm.

8. The angled adapter of claim 1, wherein the transmission assembly includes a first bevel gear coupled to the transmission coupling portion for rotation about the first axis, and a second bevel gear operatively engageable with the first bevel gear for rotation about the second axis.

9. The angled adapter of claim 8, wherein the second bevel gear defines a bore configured to receive the tool bit for rotation with the second bevel gear.

10. The angled adapter of claim 1, wherein the angle is between 75 degrees and 120 degrees.

11. The angled adapter of claim 1, wherein the tool coupling portion includes a body having a hexagonal cross-section, and wherein the outer dimension of the tool coupling portion is a width measured between two opposite flat sides of the hexagonal cross-section.

12. The angled adapter of claim 1, wherein a ratio of the length of the intermediate portion to the outer dimension of the tool coupling portion is at least 1.5.

13. An angled adapter for coupling a tool bit to a tool, the angled adapter comprising:

a housing;

a transmission assembly positioned in the housing, the transmission assembly configured to convert an input torque about a first axis from the tool to an output torque about a second axis acting on the tool bit, the second axis disposed at an angle relative to the first axis; and a shank supported by the housing and including a tool coupling portion configured to couple to the tool, the tool coupling portion having a hexagonal cross-section with a first outer dimension, the tool coupling portion defining a groove configured to receive a retention member of the tool, a transmission coupling portion coupled to the transmission assembly, the transmission coupling portion having a second outer dimension, a body positioned between the tool coupling portion and the transmission coupling portion, the body having a third outer dimension, a first reduced diameter portion extending from the tool coupling portion to the body, the first reduced diameter portion having a first diameter that is less than the first outer dimension, the second outer dimension, and the third outer dimension, and a second reduced diameter portion extending from the body to the transmission coupling portion, the second reduced diameter portion having a second diameter that is less than the first outer dimension, the second outer dimension, and the third outer dimension.

14. The angled adapter of claim 13, wherein the transmission assembly includes a first bevel gear coupled to the transmission coupling portion for rotation about the first axis, and a second bevel gear operatively engaged with the first bevel gear for rotation about the second axis.

15. The angled adapter of claim 13, the first diameter is less than the second diameter.

16. The angled adapter of claim 15, wherein the first diameter is between 4.5 mm and 5 mm, and wherein the second diameter is between 5.6 mm and 5.8 mm.

17. The angled adapter of claim 13, wherein the first reduced diameter portion defines a first length, and wherein the second reduced diameter portion defines a second length that is less than the first length.

18. The angled adapter of claim 17, wherein the first length is between 60 mm and 70 mm, and wherein the second length is between 9 mm and 12 mm.

19. An angled adapter for coupling a tool bit to a tool, the angled adapter comprising:

a housing;

a transmission assembly positioned in the housing, the transmission assembly configured to convert an input torque about a first axis from the tool to an output torque about a second axis acting on the tool bit, the second axis disposed at an angle relative to the first axis; and a shank supported by the housing, the shank extending along the first axis and including a tool coupling portion configured to couple to the tool, the tool coupling portion having an outer dimension, the outer dimension being transverse to the first axis, a transmission coupling portion coupled to the transmission assembly, and an intermediate portion extending between the tool coupling portion and the transmission coupling portion, the intermediate portion having a diameter that is less than the outer dimension;

wherein the intermediate portion defines a length, the shank has a total length, and the length of the intermediate portion forms at least half of the total length, wherein the intermediate portion includes a first reduced diameter portion and a second reduced diameter portion separated by a body, wherein the body has a second outer dimension, wherein the first reduced diameter portion has the diameter, wherein the second reduced diameter portion has a second diameter, and wherein the diameter and the second diameter are less than the second outer dimension.

20. The angled adapter of claim 19, wherein the diameter of the first reduced diameter portion is less than the second diameter of the second reduced diameter portion.

21. The angled adapter of claim 19, wherein the diameter of the first reduced diameter portion is between 4.5 mm and 5 mm, and wherein the second diameter is between 5.6 mm and 5.8 mm.

22. The angled adapter of claim 19, wherein the first reduced diameter portion defines a first length, and wherein the second reduced diameter portion defines a second length that is less than the first length.

23. The angled adapter of claim 22, wherein the first length is between 60 mm and 70 mm, and wherein the second length is between 9 mm and 12 mm.

24. An angled adapter for coupling a tool bit to a tool, the angled adapter comprising:

a housing;

a transmission assembly positioned in the housing, the transmission assembly configured to convert an input torque about a first axis from the tool to an output torque about a second axis acting on the tool bit, the second axis disposed at an angle relative to the first axis; and a shank supported by the housing, the shank extending along the first axis and including a tool coupling portion configured to couple to the tool, the tool coupling portion having an outer dimension, the outer dimension being transverse to the first axis, a transmission coupling portion coupled to the transmission assembly, and an intermediate portion extending between the tool coupling portion and the transmission coupling portion, the intermediate portion having a diameter that is less than the outer dimension;

wherein the intermediate portion defines a length, the shank has a total length, and the length of the intermediate portion forms at least half of the total length, wherein the tool coupling portion includes a body having a hexagonal cross-section, and wherein the outer dimension is a width measured between two opposite flat sides of the hexagonal cross-section.

* * * * *